US005279461A

United States Patent [19]

Darroch

[11] Patent Number: 5,279,461

[45] Date of Patent: Jan. 18, 1994

[54] SPRAY GUN

[75] Inventor: John B. Darroch, Carlsbad, Calif.

[73] Assignee: Apollo Sprayers International, Inc., Vista, Calif.

[21] Appl. No.: 753,859

[22] Filed: Sep. 3, 1991

[51] Int. Cl.[5] ..... B05B 1/28

[52] U.S. Cl. ..... 239/297; 239/290; 239/296; 239/526

[58] Field of Search ..... 239/290, 296, 297, 300, 239/301, 525, 526, 528

[56] References Cited

U.S. PATENT DOCUMENTS

| | | | |
|---|---|---|---|
| 1,722,892 | 7/1929 | Bryant | 239/301 |
| 1,752,922 | 4/1930 | Mueller | 239/297 |
| 1,824,017 | 9/1931 | Hersleb et al. | 239/528 |
| 2,740,670 | 4/1956 | Harder | 239/301 |
| 4,225,087 | 9/1980 | Lawlor | 239/526 |
| 4,531,675 | 7/1985 | Muck | 239/301 |
| 4,869,641 | 9/1989 | Hufgard | 415/121.2 |
| 4,905,905 | 3/1990 | Hufgard | 239/301 |
| 4,915,303 | 4/1990 | Hufgard | 239/300 |
| 4,948,053 | 8/1990 | Hufgard | 239/301 |
| 5,090,623 | 2/1992 | Burns et al. | 239/301 |
| 5,102,051 | 4/1992 | Smith et al. | 239/301 |

FOREIGN PATENT DOCUMENTS

| | | | |
|---|---|---|---|
| 186761 | 11/1955 | Austria | 239/301 |
| 1010079 | 6/1952 | France | 239/301 |
| 425382 | 3/1935 | United Kingdom | 239/301 |

*Primary Examiner*—Andres Kashnikow
*Assistant Examiner*—Christopher G. Trainor
*Attorney, Agent, or Firm*—Walter A. Hackler

[57] ABSTRACT

A spray gun using high volume, low pressure air includes a liquid nozzle with a conical face and a coaxial liquid outlet therein and a housing having an air chamber of greater diameter than a diameter of said liquid nozzle, for providing atomizing air to an air cap, fitted to said air chamber. The air cap has a centered opening therein subtended by a radially expanding frusto-conical surface, for accepting the conical face of said liquid nozzle. Pattern adjusting outlets are provided for directing air in a direction towards the liquid nozzle axis. A distributor, disposed within said air chamber controls and releasably coupled to the air cap, in combination with said air cap, air flow to said pattern adjusting outlets from the air chamber. The distributor is coupled to the air cap, in a manner enabling rotational movement of said air cap to control air flow to said pattern adjusting outlet.

22 Claims, 3 Drawing Sheets

SPRAY GUN

The present invention is directed to an improved paint spray gun and more particularly directed to a spray gun designed specifically for high volume, low pressure air.

Heretofore, for high pressure air, e.g., between about 20 psi to about 100 psi, has been utilized with nozzles for contacting liquids for causing atomization thereof and projecting the atomized liquid onto a surface to be painted. Because of the high pressure, a very low volume of air is necessary, e.g., about 10 cu. ft. per minute, to atomize and disperse the liquid. This method of spraying has a number of disadvantages which include high waste and, most importantly, environmental pollution.

To overcome these disadvantages, high volume, low pressure (HVLP) systems have been developed which utilize air pressures at a few psi at up to 40 cu.ft. per minute. It is the large volume of air passing in contact with a liquid in a suitable nozzle which causes atomization of the liquid.

Better control of this spray pattern, with very little overspray, is attributed to the low pressure air used. Hence, a cleaner operation is possible with an HVLP system and less pollution to the environment occurs.

A number of HVLP spray guns/nozzles has been developed. For example, see U.S. Pat. Nos. 4,905,905; 4,915,303; and 4,948,053. Each of these patents is directed to a spray nozzle for HVLP systems in which the spray pattern created by the atomizing nozzle is adjusted from a circular pattern to a flat or oval pattern thereby effecting a more efficient paint delivery. While such spray nozzle adjustment is obtained with the hereinabove referenced spray nozzles, separate adjusting levers are necessary for adjustment of the spray pattern, and further, the orientation of the spray pattern with respect to the spray nozzle cannot be altered, thus limiting or at least making a nozzle awkward to use when certain spray patterns are selected.

Further, with regard to the paint spray gun disclosed in U.S. Pat. No. 4,915,303, elaborate air channeling apparatus is required to control the air pattern. Such air channeling is necessarily restrictive in HVLP systems requiring air to be passed at low pressure but high volume into contact with liquid for atomization. Under these conditions, clear air flow channels should be provided and any restriction of such channels, as suggested by the reference, necessarily limits the air flow/air pressure characteristics of the spray gun/nozzle.

The present invention provides a spray gun having improved pattern control without the use of exterior levers and the ability to justify with respect to the gun itself for facilitating paint application. These features are most desirable and can be achieved without the necessity of changing the nozzle use. In addition, such pattern control can be accomplished without the use of restrictive air passage channels.

SUMMARY OF THE INVENTION

A spray gun, using high volume, low pressure air for atomizing liquids in accordance with the present invention generally includes a liquid nozzle having a conical face with a coaxial liquid outlet therein. Means are provided for introducing an atomizer with liquid to the liquid nozzle and means defining an air chamber of greater diameter than the diameter of the liquid nozzle within a housing provides the atomizing air.

An air cap, fitted to the air chamber and having means defining a centered opening therein, subtended by a radially expanding frusto-conical surface, is provided for accepting the conical face of the liquid nozzle. The air cap also includes means defining a pattern adjusting outlets for directing air in a direction towards the liquid nozzle axis.

A distributor, disposed within the air chamber, provides means for controlling, in combination with the air cap, air flow to the pattern adjusting outlets from the air chamber. A means is provided for coupling a distributor means to the air cap in a manner enabling rotational movement of the air cap to control air flow to the pattern adjusting outlets. Because the air cap itself may be rotated, no exterior controls are necessary for controlling the spray pattern.

High volume, low pressure air is provided by unobstructed channels to the air chamber.

More particularly, the air cap includes means defining a plurality of holes therein for providing fluid communication between the air chamber and the pattern adjusting outlets. The holes extend between the back face of the air cap and the pattern adjusting outlets, and means are further provided for releasably engaging between the air cap and the distributor with orientations therebetween for controlling the air flow through the holes.

The distributor may be rotationally fixed within the air chamber so that rotation of the air cap with respect thereto causes a change in the radial position of the pattern adjusting nozzles about the coaxial liquid outlet, thereby providing different spray patterns from the spray gun around the coaxial liquid outlet.

More particularly, the means for providing releasable engagement between the air cap and the distributor may include a plurality of indentations in the air cap back face and the distributor may include a ring having a plurality of protrusions for engaging the indentations. Spring means may be provided for biasing the ring against the air cap back face with a force causing engagement therebetween but enabling rotation of the air cap so that the protrusions may be rotated from one indentation to another.

In order to provide an unobstructed air channel, means are provided which define a straight bore within the housing extending from the air chamber to the rear of the housing. Preferably, this straight bore is disposed at an angle of about 10° with respect to the air chamber longitudinal axis.

In one embodiment of the present invention, a second straight bore is provided through a handle which interconnects the first straight bore and an air inlet on the bottom of the handle, and the first and second straight bores are disposed at about a 90° angle from one another.

In another embodiment of the present invention, a housing includes means defining an overall shape and housing diameter for enabling the housing to be handheld with fingers on one side and thumb on another side of the housing. In this embodiment, the handle is eliminated, thus providing a very compact spray gun for use in tight quarters. Importantly, the adjustable spray pattern in combination with the small size of the spray gun enables the spraying of concave surfaces, such as, for example, sinks and bathtubs, with increased facility.

BRIEF DESCRIPTION OF THE DRAWINGS

The present invention can be more readily understood by consideration of the following detailed description, particularly in conjunction with the accompanying drawings in which.

FIGS. *5b–7b* a are diagrams of spray patterns corresponding to the position of the air cap shown in FIGS. *5a–7a*.

DETAILED DESCRIPTION OF THE DRAWINGS

Figures 1, 2:
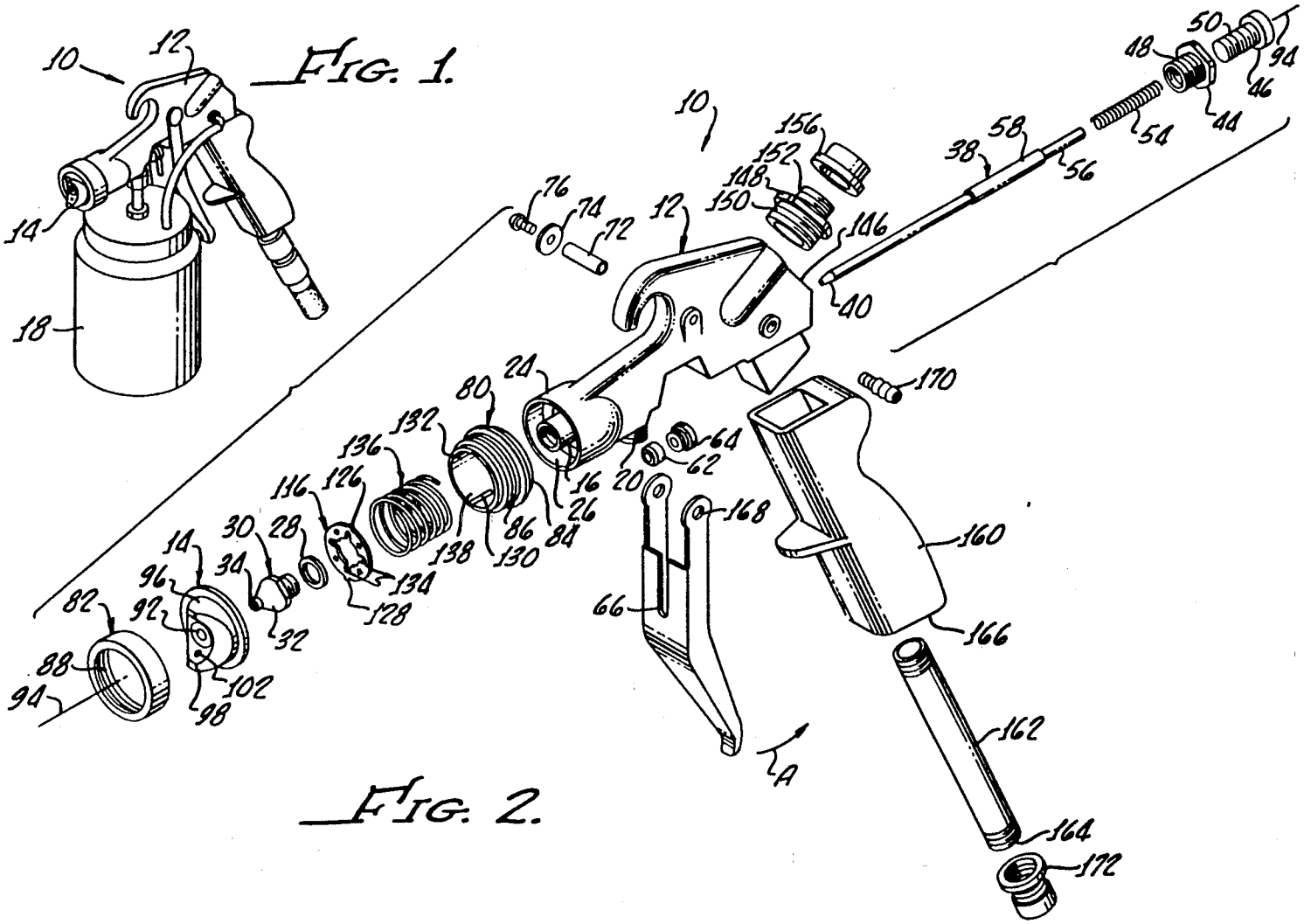
FIG. 1 is a perspective view of a spray gun in accordance with the present invention.
FIG. 2 is an enlarged exploded perspective view of the spray gun in accordance with the present invention.

Turning now to FIG. 1, there is shown a spray gun 10 in accordance with the present invention suitable for atomizing liquids with high volume, low pressure air, generally including a housing 12 and air cap 14, and a paint cup 18 conventionally attached to the housing 12 by means of a fitting 20. (See FIG. 2.)

It should be appreciated that while a paint cup 18 may be used as a means for providing an atomizable liquid to the liquid nozzle 16, any other means may be utilized, such as a tube (not shown) connecting the fitting 20 to a remote paint source (not shown). The paint cup 18 may be of any conventional design adapted for a connection to the fitting 20.

Figure 3:
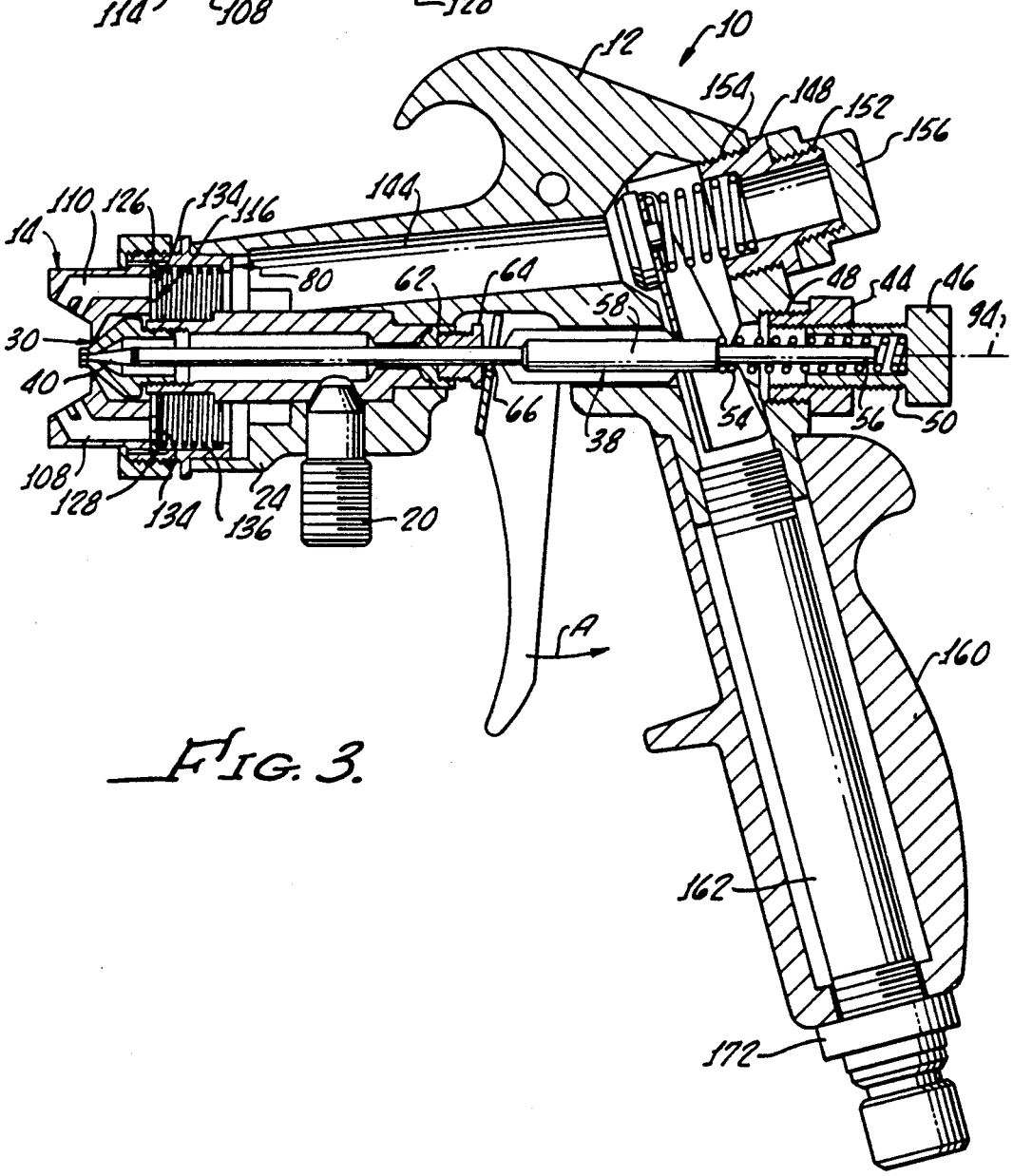
FIG. 3 is a cross-section view of the spray gun shown in FIG. 2.

More particularly, as shown in FIGS. 2 and 3, the housing 12 includes a circular front portion 24 which provides a means for defining an air chamber 26 which has a greater diameter than a diameter of the liquid nozzle 16, which provides atomizing air through the air chamber 26 to the air cap 14.

Fitted to the liquid nozzle 16 through a gasket 28 is a nozzle tip 30 which provides means for defining a conical face 32 with a coaxial liquid outlet 34 therein, the outlet 34, nozzle tip 30 and liquid nozzle 16 being in fluid communication with the fitting 20 for passing paint, or the like, therethrough from the paint cup 18.

Flow through the liquid nozzle 16 is controlled by a needle 38 passing through the housing 12 and having a tip 40 sized for engagement with the nozzle tip 30 for both sealing of the outlet 34 and allowing a metered flow of liquid therethrough.

The needle 38 is supported in the housing 12 by means of a flow screw insert 44 and a flow adjusting screw 46, each fitted by threads 48 50 respectively to the housing 12 and flow screw insert 114. A needle spring 54 is sized to slip over a rear portion 56 for abutting a shoulder portion 58 in order to bias the needle 38 in a forward engaged relationship with the nozzle tip 30.

The needle 38 passes through a gland seal 62 and gland seal nut 64 which provides means for coupling the needle 38 to a slot 66 on a trigger 8 which may be mounted to the housing 12 via a trigger bushing 72, trigger screw washer 74 and trigger pivot screw 76. In operation, the engagement of the trigger slot 66 with the gland seal 62 and gland seal nut enables rearward motion of the needle 38 when the trigger is moved in the direction indicated by the arrow A in order to pass an atomizable liquid through the liquid nozzle 16 and outlet 34.

The air cap 14 is fitted to the air chamber 26 by an air feed tube 80 and an air cap ring 82, each being provided with threads 84 86 88 for that purpose in a conventional manner. It should be appreciated that, when so fitted, the air cap 14 is not rotationally fixed to the air chamber but is allowed to rotate in order to adjust the spray pattern as will be hereinafter described in greater detail.

As more clearly shown in FIG. 3, the air cap 14 includes a central opening 92 for accepting the outlet 34 and enabling air to pass over the conical face 32 for atomizing engagement with liquid passing through the outlet 34.

In that regard, as best shown in FIG. 3, the central, or centered, opening 92 is subtended by a radially expanding frusto-conical surface, disposed at an angle with regard to the axis 94 for accepting the conical face 32 of the liquid nozzle tip 30. In addition, the air cap 14 includes a pair of ears 96 98, including pattern adjusting outlets 102.

Figure 4:
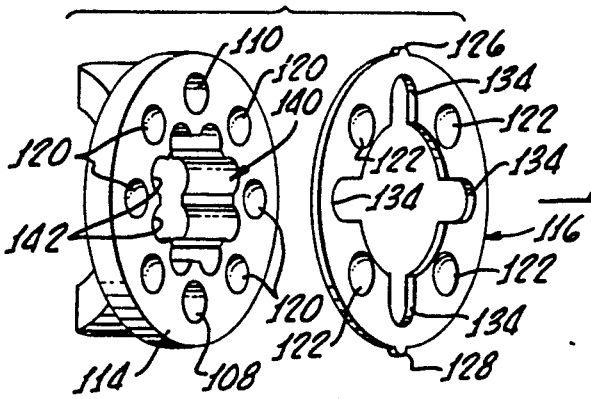
FIG. 4 is an enlarged perspective view of an air cap and a distributor in accordance with the present invention.

A plurality of holes 108, 110 (see FIG. 4) communicate with the pattern adjusting outlets 102, 104, respectively, to a back face of the air cap 14.

An air distributor 116 is disposed within the air chamber 26 and behind the air cap 14 which provides means, in combination with the air cap 14, for controlling the air flow to the air pattern adjusting outlets 102, 104 from the air chamber 26.

In addition to the holes 108, 110, the back face 114 of the air cap 14 includes a plurality of indentations 120 and the air distributor plates 116 include a plurality of protrusions 122 which, in combination, provide a means for releasably engaging the air cap 14 and the air distributor plate 116 at orientations therebetween for controlling the air flow through the holes 108 110.

Figure 5A:
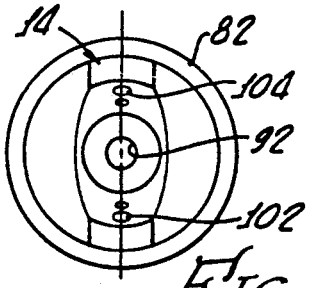
Figure 5B:
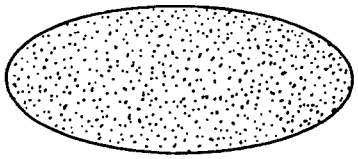

A pair of tabs 126 128, sized for engagement with slots 130 132, in the air cap tube 80 (see FIG. 2) prevent rotation of the distributor plate 116 so that rotation of the air cap with respect thereto causes a change in the radial position of the pattern adjusting outlets about the coaxial liquid outlet 34 thereby providing different spray patterns from the spray gun around the coaxial liquid outlet 94, as shown in FIG. 5. As shown, the air cap 14 has three distinct "click" positions located by revolving the air cap 14.

As shown in FIG. 5, when the ears 96 98 are in horizontal orientation, a vertical fan spray pattern is produced and when the ears are in a vertical position, a horizontal fan pattern is produced. Intermediate positions of the ears 96 along with spray pattern adjusting outlets 102, 104 produce a circular spray pattern because air flow at these positions is prevented through the spray pattern adjusting nozzles 102, 104 by the air distributor plate 116. Notches 134 in the air distributor plate 116 control air flow through the spray pattern adjusting outlets 102 104, and rotation of the air cap 14 determines the orientation of the direction of air exiting the outlets 102, 104 in direction toward the liquid nozzle axis 94. (See FIGS. *5a–7a*.) As shown when the pattern adjusting outlets 102, 104 are vertically oriented, an oval spray pattern, FIG. *5b*, is produced, having a horizontal major axis and when the pattern adjusting outlets 102, 104 are horizontally oriented, an oval spray pattern, FIG. *7b*, is produced having a vertical major axis.

Figure 6A:
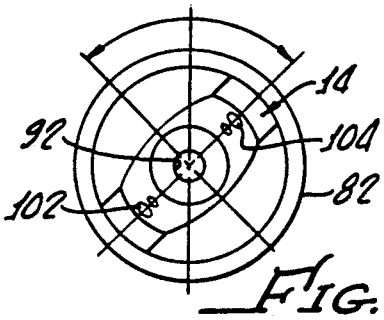
Figure 6B:
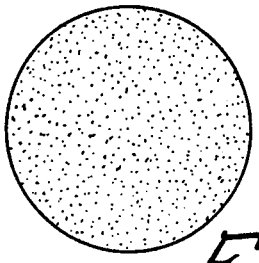
Figure 7A:
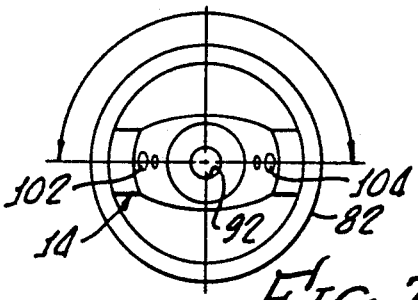
Figure 7B:
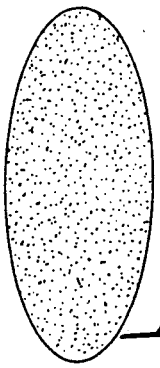

When the pattern adjusting outlets 102, 104 are oriented at intermediate 45° positions shown in FIG. 6*a*, air flow therethrough is stopped by the distributor plate 116 and a circular spray pattern as shown in FIG. 6*b* is produced.

It should be appreciated that no exterior levers or devices are necessary to make this adjustment. It is simply done by turning the air cap 14 to ensure positive engagement of the air distributor cap 116 with the air cap back face 114. An air distributor spring 136 is provided which closely fits an inside diameter 134 of the air feed tube 80 to enable unimpeded air flow therethrough.

Air flow around the nozzle tip 30 is facilitated by an air cap interior surface 140 having a scalloped pattern 142 with depending portions 144 contacting an exterior of the nozzle tip 30. The scalloped pattern 142 thereby provides a means for distributing and guiding air across the face 32 of the nozzle tip 30 in a laminar flow manner.

As shown in FIG. 3, an unobstructed air channel 144 through the housing 12, preferably having a diameter of at least ½", provides means for introducing high volume, low pressure air into the air chamber 16.

The air channel, or bore, 144 extends from the air chamber 26 to a rear 146 into which an upper port insert 148 is screwed by threads 150. The upper port insert 148 enables an air supply tube (not shown) to be connected thereto by way of threads 152, thus providing an air supply relatively in-line with the axis 94. Alternatively, this air supply route may be capped by an air plug 156.

In order to facilitate air flow and reduce turbulence within the air chamber 26, the straight bore 144 may be disposed at an angle of about 10° with respect to the axis 94, which is also the longitudinal axis of the air chamber 26.

As shown in FIGS. 1-3, a handle 160 may be attached to the housing 12 which provides means for enabling hand support of the housing and in addition a handle tube 162 may be inserted through the handle 160 for providing a second straight bore therethrough which extends from the first straight bore 144 to a second air inlet 164 on a bottom 166 of the handle 160. The handle 160 may be attached to the housing in any conventional manner such as a pin 170. When an air supply is connected to the upper port insert 148, the second air inlet 164 may be capped or sealed by a conventional air hose quick release coupler 172.

Alternatively, when the upper port insert 148, which serves as a first air inlet, is sealed with the plug 156, the air supply (not shown) may be coupled to the coupler 172 for providing air through the handle tube 162 and first straight bore 144 into the air chamber 26. As shown, the first and second straight bores 144, 162 are disposed at about 90° from one another, thus providing the versatility to the air spray gun 10 and facilitating its movement in a spraying operation.

Figure 8:
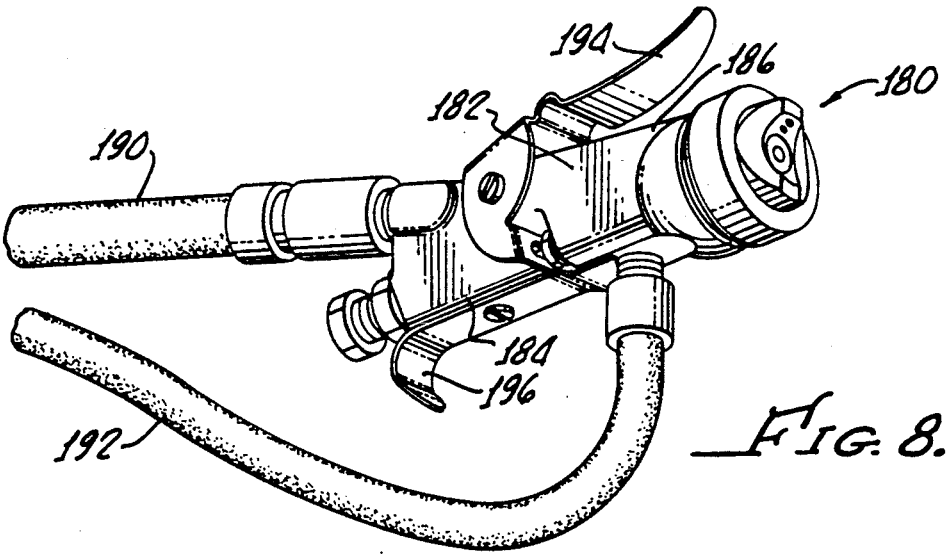
FIG. 8 is an alternative embodiment of the present invention suitable for spraying in tight quarters.

Another embodiment 180 of the present invention is shown in FIG. 8, which does not have a separate handle. The inner workings of the spray gun 180 are identical to that described in connection with the spray gun 10 and like character references are provided for identical, or substantially the same, parts.

As shown, the housing 182 of the spray gun 180 itself provides means for enabling the housing to be handheld with the fingers on one side 184 of the housing 180 and a thumb on another side 186 of the housing 180. This embodiment 180 enables substantially parallel air supply and liquid supply lines 190, 192 to be guided along an arm of the user (not shown) to facilitate movement of the spray gun 180 in tight quarters. A trigger 194, attached to the housing 182, is provided for interconnection with the needle 138 for controlling the movement thereof and the supply of liquid to the liquid nozzle 16, as hereinbefore described in connection with spray gun 10. In addition, a finger support 196 is provided on the one side 184 for facilitating grasp and manipulation of the spray gun 180.

Although there has been hereinabove described specific arrangements of spray guns for the purpose of illustrating the manner in which the invention can be used to advantage, it should be appreciated that the invention is not limited thereto. Accordingly, any and all modifications, variations, or equivalent arrangements which may occur to those skilled in the art, should be considered to be within the scope and spirit of the present invention as defined by the appended claims.

What is claimed is:

1. A spray gun using high volume, low pressure (HVLP) air for atomizing liquids, said spray gun comprising:

a liquid nozzle having means defining a conical face with a coaxial liquid outlet therein;

means for passing an atomizable liquid through said liquid nozzle;

a housing having means, defining an air chamber of greater diameter than a diameter of said liquid nozzle, for providing atomizing air without obstruction to reduce incoming air pressure;

an air cap, fitted to said air chamber and having means, defining a centered opening therein subtended by a radially expanding frusto-conical surface, for accepting the conical face of said liquid nozzle, and means, defining pattern adjusting outlets, for directing air in a direction towards the liquid nozzle axis;

distributor means, disposed within said air chamber for controlling, in combination with said air cap, low pressure air flow to said pattern adjusting outlets from said air chamber;

indexing means, coupling said distributor means to said air cap, for enabling rotational movement of said air cap and causing the air cap to take one of a plurality of discrete angular portions in order to control air flow to said pattern adjusting outlets, each said discrete angular portions enabling either no air flow or maximum air flow to said pattern adjusting outlets; and unobstructed air channel means for introducing high volume, low pressure air into said air chamber.

2. The spray gun according to claim 1 wherein said air cap includes means, defining a plurality of holes therein, for providing fluid communication between said air chamber and said pattern adjusting outlets, said holes extending between a back face of said air cap and said pattern adjusting outlets and said distributor means includes a ring having a plurality of holes for controlling air flow through the air cap holes.

3. The spray gun according to claim 2 wherein said indexing means includes a plurality of indentations in the air cap back face and a plurality of protrusions in said ring, for engaging said indentations, and the spray gun further comprises spring means for biasing said ring against the air cap back face.

4. The spray gun according to claim 2 wherein the distributor means is rotationally fixed within said air chamber so that rotation of the air cap with respect thereto causes a change in radial position of the pattern adjusting outlets about the coaxial liquid outlet, thereby providing different spray patterns from the spray gun around the coaxial liquid outlet without rotation of the spray gun about the liquid outlet.

5. The spray gun according to claim 3 wherein said air cap includes means, defining an interior surface, subtending said frusto-conical surface, for enabling air flow over said liquid nozzle conical face and through said centered opening for atomizing liquid exiting the liquid outlet in said liquid nozzle, said interior surface having a scalloped pattern with depending portions therefor contacting an exterior of said liquid nozzle.

6. The spray gun according to claim 5 wherein said unobstructed air channel means includes means defining a straight bore within said housing extending from said air chamber to a rear of said housing.

7. The spray gun according to claim 6 wherein the straight bore is disposed at an angle of about 10° with respect to an air chamber longitudinal axis.

8. A spray gun using high volume, low pressure (HVLP) air for atomizing liquids, said spray gun comprising:

a liquid nozzle having means defining a conical face with a coaxial liquid outlet therein;

means for passing an atomizable liquid through said liquid nozzle;

a housing having means, defining an air chamber of greater diameter than a diameter of said liquid nozzle, for providing atomizing air without obstruction to reduce incoming air pressure;

a handle means for enabling hand support of the housing;

an air cap, fitted to said air chamber and having means, defining a centered opening therein subtended by a radially expanding frusto-conical surface, for accepting the conical face of said liquid nozzle, and means, defining pattern adjusting outlets, for directing air in a direction towards the liquid nozzle axis;

distributor means, disposed within said air chamber, for controlling, in combination with said air cap, low pressure air flow to said pattern adjusting outlets from said air chamber;

indexing means, coupling said distributor means to said air cap, for enabling rotational movement of said air cap and causing the air cap to take discrete angular patterns in order to control air flow to said pattern adjusting outlets, said discrete angular position enabling either no air flow or maximum air flow to said pattern adjusting outlets; and air channel means for introducing high volume, low pressure air into said air chamber, said air channel means including means defining a first straight bore within said housing and extending from said air chamber to a first air inlet on a rear of said housing and means defining a second straight bore through the handle means and extending from said first straight bore to a second air inlet on a bottom of said handle means.

9. The spray gun according to claim 8 wherein said first and second straight bores are disposed at about 90° from one another.

10. The spray gun according to claim 8 wherein said air cap includes means, defining a plurality of holes therein, for providing fluid communication between said air chamber and said pattern adjusting outlets, said holes extending between a back face of said air cap and said pattern adjusting outlets and said distributor means includes a ring having a plurality of holes for controlling air flow through the air cap holes.

11. The spray gun according to claim 10 wherein said indexing means includes a plurality of indentations in the air cap back face in said ring for engaging said indentations, and the spray gun further comprising spring means for biasing said ring against the air cap back face.

12. The spray gun according to claim 10 wherein the distributor means is rotationally fixed within said air chamber so that rotation of the air cap with respect thereto causes a change in radial position of the pattern adjusting outlets about the coaxial liquid outlet, thereby providing different spray patters from the spray gun around the coaxial liquid outlet, without rotation of the spray gun about the liquid outlet.

13. The spray gun according to claim 10 wherein said air cap includes means, defining an interior surface, subtending said frusto-conical surface, for enabling air flow over said liquid nozzle conical face and through said centered opening for atomizing liquid exiting the liquid outlet in said liquid nozzle, said interior surface having a scalloped pattern with depending portions therefor contacting an exterior of said liquid nozzle.

14. The spray gun according to claim 13 wherein the first straight bore is disposed at an angle of about 10° with respect to an air chamber longitudinal axis.

15. A spray gun using high volume, low pressure (HVLP) air atomizing liquids, said spray gun comprising:

a liquid nozzle having means defining a conical face with a coaxial liquid outlet therein;

means for passing an atomizable liquid through said liquid nozzle;

a housing having means, defining an air chamber of greater diameter than a diameter of said liquid nozzle, for providing atomizing air, without obstruction to reduce incoming air pressure, said housing further having means defining an overall shape and housing diameter, for enabling said housing to be hand held with fingers on one side of the housing and thumb on another side of the housing;

an air cap, fitted to said air chamber and having means, defining a centered opening therein subtended by a radially expanding frusto-conical surface, for accepting the conical face of said liquid nozzle, and means, defining pattern adjusting outlets, for directing air in a direction towards the liquid nozzle axis;

distributor means, disposed within said air chamber, for controlling, in combination with said air cap, low pressure air flow to said pattern adjusting outlets from said air chamber;

indexing means, coupling said distributor means to said air cap, for enabling rotational movement of said air cap and causing the air cap to take discrete angular positions in order to control air flow to said pattern adjusting outlets, said discrete angular positions enabling either no air flow or maximum air flow to said pattern adjusting outlets; and unobstructed air channel means for introducing high volume, low pressure air into said air chamber.

16. The spray gun according to claim 15 wherein said means for providing an atomizable liquid to the liquid nozzle includes a needle valve means disposed within said liquid nozzle for controlling flow of atomizable liquid through the liquid nozzle, and trigger means, disposed on one side of said housing in a position for operation by a finger when the nozzle housing is handheld, for controlling movement of the needle valve means.

17. The spray gun according to claim 16 wherein said air cap includes means, defining a plurality of holes therein, for providing fluid communication between said air chamber and said pattern adjusting outlets, said holes extending between a back face of said air cap and said pattern adjusting outlets and said distributor means, includes a ring having a plurality of holes for controlling air flow through the air cap holes.

18. The spray gun according to claim 16 wherein said indexing means includes a plurality of indentations in the air cap back face and a plurality of protrusions in said ring for engaging said indentations, and the spray gun further comprises spring means for biasing said ring against the air cap back face.

19. The spray gun according to claim 17 wherein the distributor means is rotationally fixed within said air chamber so that rotation of the air cap with respect thereto causes a change in radial position of the pattern adjusting outlets about the coaxial liquid outlet, thereby providing different spray patterns from the spray gun around the coaxial liquid outlet without rotation of the spray gun about the liquid outlet.

20. The spray gun according to claim 18 wherein said air cap includes means, defining an interior surface, subtending said frusto-conical surface, for enabling air flow over said liquid nozzle conical face and through said centered opening for atomizing liquid exiting the liquid outlet in said liquid nozzle, said interior surface having a scalloped pattern with depending portions therefor contacting an exterior of said liquid nozzle.

21. The spray gun according to claim 20 wherein said unobstructed air channel means includes means defining a straight bore within said housing extending from said air chamber to a rear of said housing.

22. The spray gun according to claim 21 wherein the straight bore is disposed at an angle of about 10° with respect to an air chamber longitudinal axis.

* * * * *